United States Patent [19]

Hepp

[11] 4,428,487

[45] Jan. 31, 1984

[54] DUAL SIDE WALL LOCKING ATTACHMENT FOR TRAYS TO VERTICAL LEGS IN SECTIONAL DISPLAY RACK

[76] Inventor: James Hepp, 27-50 First St., Long Island City, N.Y. 11102

[21] Appl. No.: 368,704

[22] Filed: Apr. 15, 1982

[51] Int. Cl.[3] ..... A47F 3/14

[52] U.S. Cl. ..... 211/126; 108/91; 108/92; 108/111; 206/511; 206/512; 211/188

[58] Field of Search ..... 211/128, 126, 186, 187, 211/188, 194; 108/91, 92; 206/509, 512, 821, 598, 511, 510

[56] References Cited

U.S. PATENT DOCUMENTS

| | | | |
|---|---|---|---|
| 982,538 | 1/1911 | Senge | 211/126 |
| 1,147,975 | 7/1915 | Ruff | 211/126 |
| 2,495,711 | 1/1950 | Fletcher | 108/53.5 |
| 3,053,558 | 9/1962 | Challas et al. | 108/91 X |
| 3,361,293 | 1/1968 | Box | 206/511 |
| 3,445,034 | 5/1969 | Rehrig | 206/512 |
| 3,490,602 | 1/1970 | Wentzel | 211/126 |
| 3,533,512 | 10/1970 | Serner | 211/126 |
| 3,704,792 | 12/1972 | Wiese | 108/91 X |
| 3,834,324 | 9/1974 | Lang | 108/91 |
| 4,293,072 | 10/1981 | Hill et al. | 206/512 |
| 4,366,905 | 1/1983 | Forshee | 206/821 X |

*Primary Examiner*—Ramon S. Britts
*Assistant Examiner*—Blair M. Johnson
*Attorney, Agent, or Firm*—A. A. Saffitz

[57] ABSTRACT

A sectional display rack comprising a novel construction of horizontal rectangular trays and support legs, each tray and leg formed of plastic, wherein both upper and lower sides on each tray bottom wall are formed with upstanding ribs defining a space between the rib and the side wall into which a wing portion of each support leg is fitted and in which wedge shaped cams are provided on side walls of the tray to lock in corresponding recess or groove portions in the wing portions of the supporting leg to lock the leg in position. A spaced apart pair of wedge shaped cams is provided in each wall and the cams in the upper wall portion above the floor of the tray are offset from those cams formed in the lower wall. The advantages of these upright rib projections on the bottom walls and the locking tabs in the side walls in the tray are to provide a stable rack and to permit a low cost molding operation for manufacturing the attachment means comprising ribs, cams and recesses above and below the tray floor. The ribs are each preferably formed with a rounded end at the trailing edge which co-acts with a reversed beveled edge on the support legs by a camming action. In this camming manner the fitting of the corner posts into the space between the tabs adapts the legs to be placed above and below floor each tray thereby facilitating stacking of sections of the display rack which is suitable for displaying merchandise in department stores, hardware stores, pharmacies, food markets and the like.

6 Claims, 6 Drawing Figures

DUAL SIDE WALL LOCKING ATTACHMENT FOR TRAYS TO VERTICAL LEGS IN SECTIONAL DISPLAY RACK

BACKGROUND OF THE INVENTION

This invention relates to sectional display racks generally of rectangular trays and comprising vertical supporting legs having a right angle section at each of the corners of the tray. Specially molded ribs are formed on the tray to constitute projecting means on opposite bottom walls of each tray. These ribs are adapted to receive a wing portion of a supporting leg in the space between the upright projecting rib and the side wall of the tray. Locking means which lock the wings of the supporting legs vertical into secure engagement are comprised of a pair of cam projections on the side wall which fit into recesses in the wings after the edge of the upstanding leg is inserted in the space between the projection and the wall.

The invention further relates to modifications of the ends of the supporting legs to adapt the assembly of sections of a plurality of trays as part of the support structure so that the rib is shaped at its leading and trailing edge so that a camming action can occur between a trailing edge of the upright or depending rib above or below the bottom wall of the tray and the bottom edge of the vertical supporting leg to assure a fit into a pair of slots at each wing of the supporting legs.

The invention further relates to improvements in the tray structure at the corner and in the bottom portion to cause reinforcement of the bottom web by the provision of strips and to cause a strengthening at the corners by increasing the thickness of the tray at the corners wherein the material which constitutes the tray is formed of a high impact thermoplastic or thermosetting material.

DESCRIPTION OF THE PRIOR ART

Plastic trays and crates have been formed with corner stacking elements as for example Rehrig U.S. Pat. No. 3,445,034 but these have not been adapted for use in display cases and the stacking members have been limited for facilitating storage of these crates in nesting relation.

Corner guides have been used for pallet stacking as in Fletcher U.S. Pat. No. 2,495,711 but such corner guides have not found use in display cases by reason of the bulkiness of the construction. Plastic trays with vertical support members separating individual trays in a stack have been disclosed in U.S. Patent to Serwer U.S. Pat. No. 3,533,512 but stacking trays of this construction have not been useful for display purposes.

Sectional box racks utilizing corner elements with clasping members fitted about the corners have been described in Ruff U.S. Pat. No. 1,147,975 and although racks of this type have been used for hardware, fruits, vegetables, etc., these racks have not been adapted for manufacture in plastic and generally require the inclusion of fastening screws to tighten the fingers which hold the corners of each post in the rack.

A display case formed of plastic trays and vertical plastic posts has been described in the Lang U.S. Pat. No. 3,834,324 and this patent requires the provision of a special right angle corner lug at each of the corners on the upper and lower surface of each tray to provide a slot into which the end of a corner post is inserted in telescope fashion so that the bottom edge of the post rests against the bottom of the tray or against the top of the tray in the nest stacked tray above and below.

SUMMARY OF THE INVENTION

The present invention differs over the Lang U.S. Pat. No. 3,834,324 in providing ribs constituting dual side wall locking attachments and modified vertical supporting legs instead of the right angle corner member which is used in Lang U.S. Pat. No. 3,834,324 and in further providing a mounted reverse bevel on the supporting leg which cooperates with a rounded end of the rib on the bottom wall, one rib projecting up and another at the same location but the opposite side projecting downwardly. The bottom edge of the vertical supporting leg moves readily into the space between the rib on the bottom wall and the side wall. The part of the supporting leg which enters the space is a wing of the leg and the wing enters at a location remote from the corner. These wings are provided along the bottom edge and are also provided along the top edge of each vertical supporting leg. These wings thus co-act with each side wall above and below the tray floor. The locking attachments constituted at each side wall are formed by recess elements on the wings, the wings being integral with the vertical supporting legs and being provided with grooves to accommodate a pair of locking tabs integral with the side wall of the tray. Thus, a pair of locking tabs are provided on the upper side of the tray. Another pair of locking tabs are on the under side of the tray. The upper pair of locking tabs are offset inwardly from the narrower pair of locking tabs on the bottom side of the tray thereby contributing to the stability of the display rack assembly.

DESCRIPTION OF THE PREFERRED EMBODIMENTS

Figure 1:
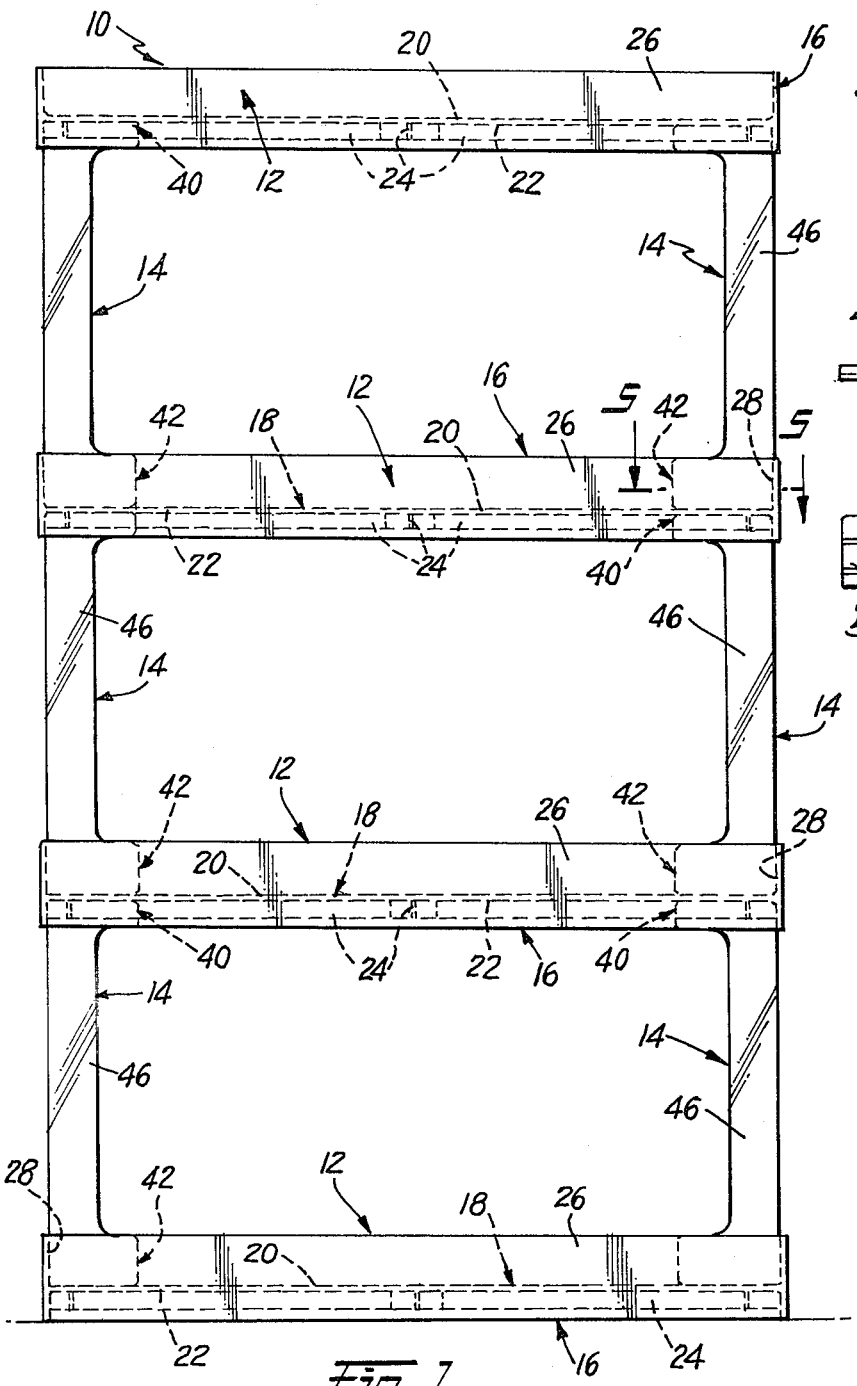
FIG. 1 is a side elevation view of the display rack of the present invention.
Figure 6:
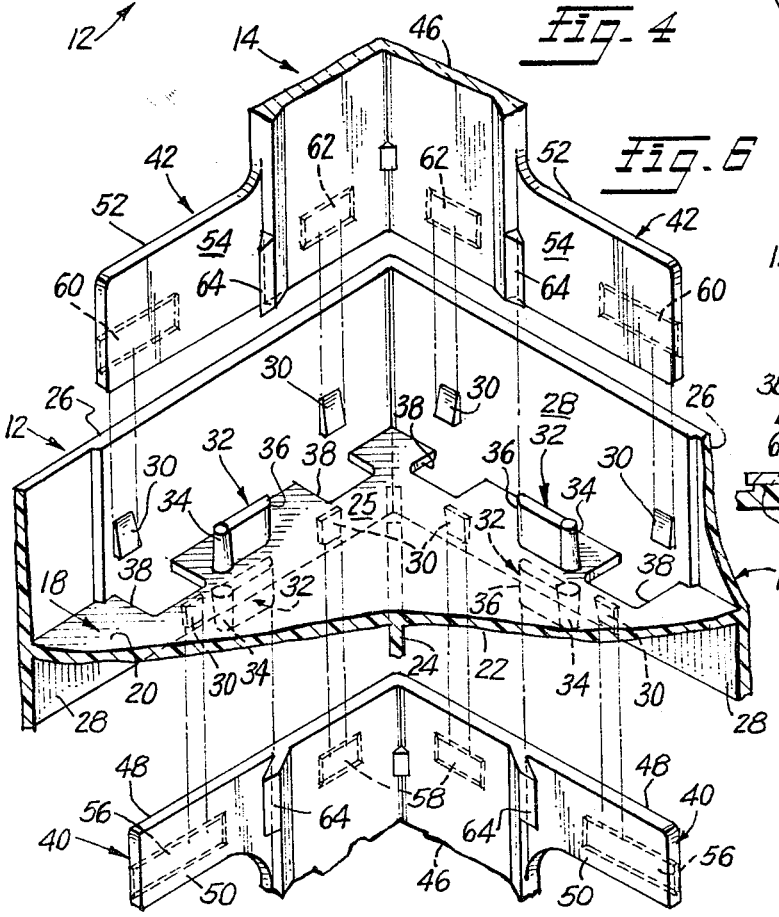
FIG. 6 is an isometric fragmentary exploded view of a corner of the display rack, partly in section, illustrating the cooperation between the tray and the top and bottom of a supporting leg.

In FIG. 1 there is shown a preferred display rack 10 of the present invention comprising a plurality of horizontal rectangular trays 12 each with support legs 14 at each of the corners of the trays 12 to build up a rack of a plurality of trays constituting the sections. Each tray 12 comprises flanges 16, a planar floor 18 which has a top surface 20 and a bottom surface 22, the floor 18 being intermediate between the top and bottom of the flanges 16. In the preferred form shown in the Figs of the drawings, and as shown in FIGS. 1 and 6 particularly, the upper wall portion of flange 16 is higher than the lower wall portion of flange 16 which adapts the tray to support a variety of articles of different heights within the higher side wall portions of tray 12. This facilitates the tray for display purposes with a variety of articles when the tray is assembled in the sectional rack and further imparts a stability to the rack when it is loaded with articles at various levels. Each of the support legs 14 is formed in a dihedral angle of 90° with upper and lower projecting wings 40 and 42 which take part in a unique co-action between the support legs 14, dual side wall locking means in the tray and ribs 32 in the floor 18 of each tray 12 both at the upper surface 20 and the lower surface 22.

Figure 4:
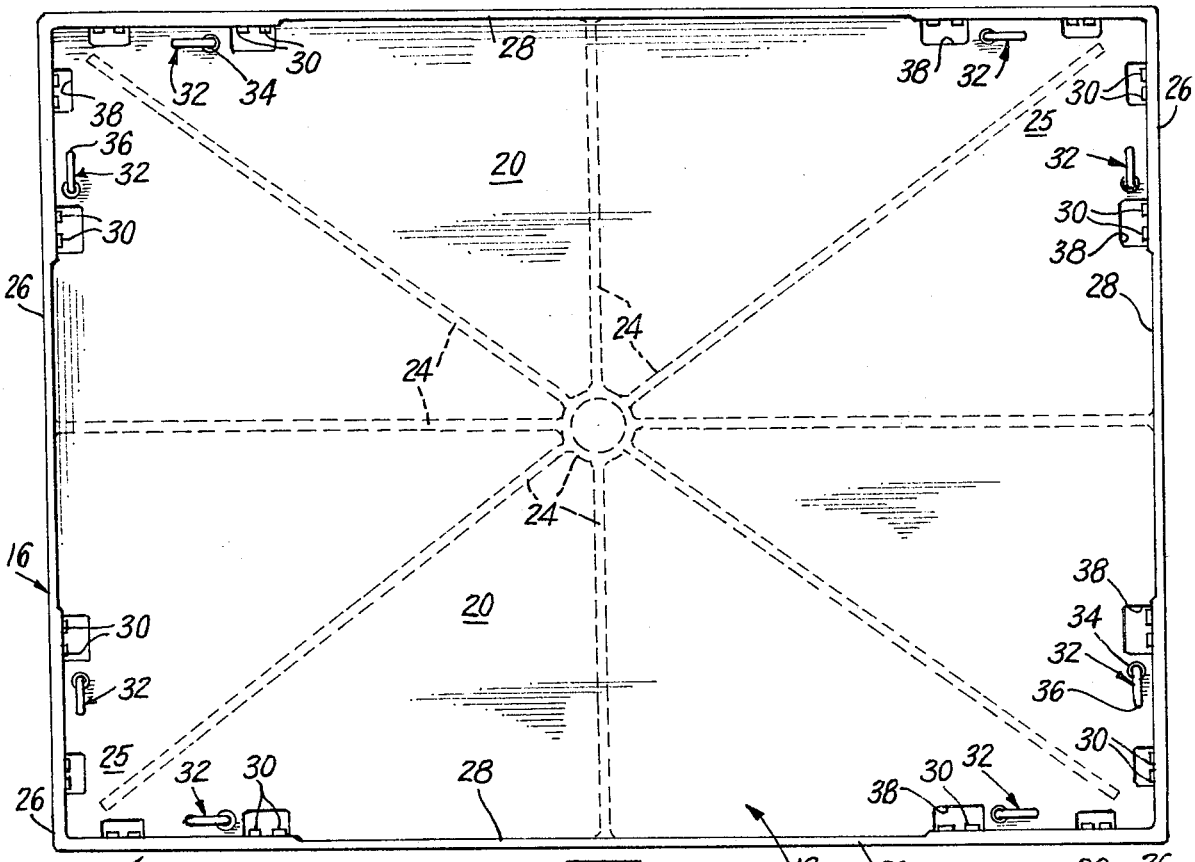
FIG. 4 is a plan view of a tray comprising the display rack.

The bottom surface 22 of the tray 12 is reinforced so that the longitudinal portion of the tray will not flex unduly and for this purpose strips 24 are provided which extend radially from the center to the corners as diagonals and from the center to the sides in straight line bisecting relationship as shown in FIG. 4.

The novel dual side wall locking attachment for the trays to the support legs is provided by a pair of ribs 32 which project from the top surface 20 upwardly and from the bottom surface 22 downwardly, each of these ribs being identical and being best shown in the isometric fragmentary exploded view of the corner of the rack 10 in FIG. 6.

The support legs 14 which fit into the corner of the rectangular tray by virtue of the dihedral cross section of 90° are adapted to fit into the corner of any regular polygonal tray, the only change being in the angle of the polygon which constitutes the dihedral angle of the support leg which fits into this corner. The aspect of the support leg 14 which uniquely adapts the leg for cooperation in assembling a sectional display rack is the relationship of the wing portion 40 and 42 at the lower and upper ends of the leg which are covered by the flange 16 of the tray 12. In the preferred rectangular form shown in FIG. 1 the lower wing portion 40 of the support leg 14 has a greater height than the upper wing portion 42 since the flange which projects above the bottom wall 22 of the tray is deeper than the top or roof portion of the adjacent upper tray which is engaged by the wing portions 42 extended at the dihedral angle of 90° from the body portion 46 of the support leg 14. It is a unique advantage and characteristic of the wing portions 40 and 42 that they have a flexibility which is greater than the flexibility of the body portion 46; this flexibility is due to a reduction in thickness and due to the elongated shape, the elongation and thickness reduction both contributing to the easy edge engagement of the upper and lower edges of wing portions 40 and 42 respectively within the dual rib projections 32.

Figure 2:
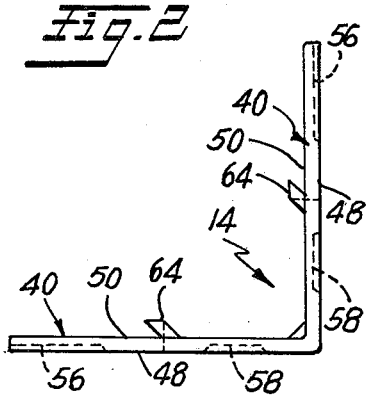
FIG. 2 is top edge view of a support leg for the display rack of FIG. 1.
Figure 3:
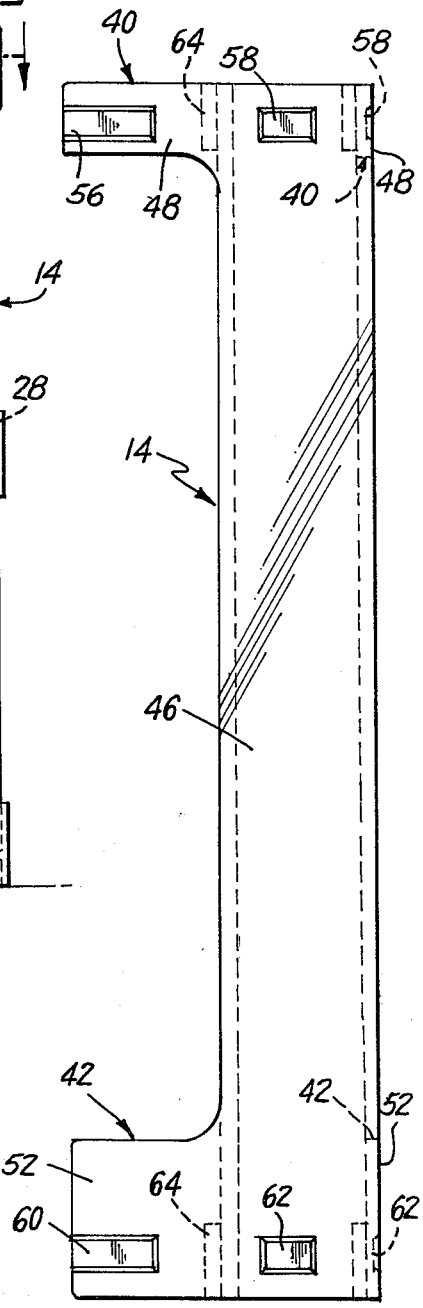
FIG. 3 is a side elevational view of the support leg of FIG. 2.

The structural and interlocking relationships of the upper wing portion 40 to the dependent side wall portion 22 of the upper tray flange 16 as shown in FIG. 1 is significantly different than the structural and interlocking relationship of the lower wing portion 42 to the bottom of the tray. The tray surface inside of which the wing edges 40 and 42 come together lies within the space defined by the rib 32 on the underside of the floor and the rib 32 which projects upwardly from the floor, this edge engagement being shown best in the exploded view of FIG. 6. The specific locking features and camming features on the wings, side wall, tray floor and rib respectively can also be seen in FIGS. 1–3 and these are preferred to specifically to show the novel parts of the support leg structure which cooperate with the tray sides and bottom as shown in FIG. 6.

As shown in FIG. 6 each rib 32 projects from the top surface 20 and bottom surface 22 to provide a similar space between the inner surface 28 of the flange 16 which constitutes the side wall of the tray into which the contents are displayed and which forms a similar space between the inner surface 28 of the lower portion of the flange.

As can be seen by comparing the height of the upper and lower wall portions of planar side wall 18 in tray 12 in FIGS. 1 and 6, the upper wall height dimension is approximately about twice as great as the lower wall and the depth of the tray represented by this upper wall portion 20 is correspondingly twice as deep. This enhanced depth adapts the tray to receive bulky and top heavy items for display within the tray sides which will not tip or tilt to or outside of the walls of the tray.

Figure 5:
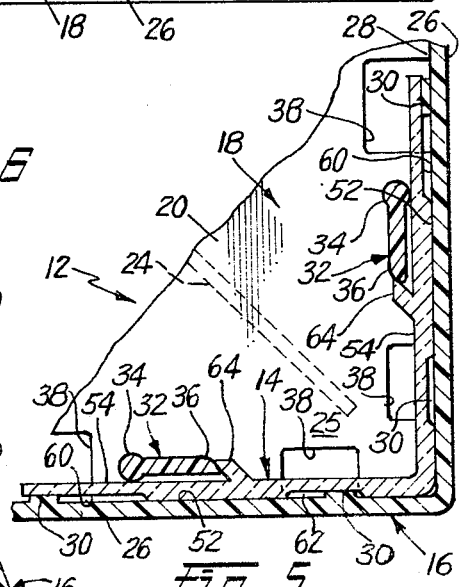
FIG. 5 is an enlarged fragmentary horizontal sectional view, through one corner of the display rack, taken on the line 5—5 of FIG. 1.

An important advantage of the invention is provided by the structure of the ribs 32 which co-act with the wings 40 and 42 on the support legs 14. As can be seen in FIGS. 5 and 6, the ribs 32 are each provided with a conical surface 34 along the trailing edge. The leading edge of the rib 36 is provided with a reverse bevel taper to accommodate a reverse bevel projection 64 which is formed along the lower side edge of the support leg 14. The camming action of the rib surface 36 against the reverse bevel projection 64 is shown best in FIG. 5. The combination of dual camming surfaces on each rib surface 34 at the trailing edge and surface 36 at the leading edge with rib to the corner of the tray 12 permits each wing 40 and 42 at the top and bottom of each support leg 14 to be easily and assuredly internally fitted in the space between the rib 32 and the inner wall of the tray whether it be the upper wall 20 or the bottom wall 22.

A further feature of the invention consists of the locking means provided within the wall or flange 16 of the tray itself, a pair of wedge shaped cams being provided on wall 28 which comprises the inner surface of the flange 16 of the tray and a corresponding pair of wedge shaped cams being positioned in the lower wall portion of the wall 28 and these latter being shown in dotted outline in FIG. 6. It is noteworthy that the spacing between the pair of wedge shaped cams 30 above the floor 22 is greater than the spacing between the wedge shaped cams 30 located below the floor and the result is to offset the locking attachment since each of these wedge shaped cams 30 engages a recess which is provided in the wings, the recesses in wing 40 of support leg 14 bearing reference numeral 56 and the recesses in body 46 bearing reference numeral 58. Similarly, attachment is aided by the recesses in wing 42 bearing reference numeral 60 and the recesses in the body portion of the support leg 14 bearing reference numeral 62.

It is further noted that the extent of lateral play which each of the recesses provide for accommodating the wedge shaped cams 30 is sufficient to permit easy engagement and to facilitate a snap fit of the cam 30 within each recess at each location where the cams have corresponding recess and are brought together. In this manner there is assured a stable locking attachment wherein a pair of cams lock the wall portions into recesses within the mating wing portions as these wing portions are inserted into the corners with the upstanding ribs angularly contacting the lower edge of the wings in the space between the rib and the wall of the tray.

I claim:

1. A sectional display rack comprising:

a plurality of horizontal regular polygonal trays, each tray formed of plastic material with a planar bottom supporting surface which is located intermediate the flanged side walls of the regular polygon;

a support leg of dihedral cross section fitted into each corner of each tray, each support leg formed of plastic having a body portion and a winged portion which extends from the corner of said body portion at the top and bottom, said wing portion being covered by the flange of the tray so that the height of the lower wing portion of the supporting leg is approximately equal to the flange projecting above the bottom wall of the tray and height of the upper wing portion is approximately equal to the height of the flange projecting downwardly below the bottom wall of the tray;

dual rib projections having a curved edge extending substantially perpendicular to the bottom floor of the tray, one dual set above and one dual set below the bottom floor of the tray at a location away from the dihedral corner of the tray to provide a space as thick as the wing portion of the support leg whereby the edge of the lower wing portion extending dihedrally from the corner comes into engagement with the inner wall of the tray upon which the legs are supported and the upper wing portions fit next to the wall of the flange at the top of the leg and below the bottom support of the tray at the top of said leg;

a reversed beveled edge at the bottom of each wing portion to adapt the fitting of each wing portion to the curved edge of said rib; and locking means included in said trays and support legs comprising wedge shape cams and recesses to lock the wings next to the inner wall of each tray when the trays and support legs are assembled.

2. A sectional display rack as claimed in claim 1 wherein said wedge shaped cams are formed as two spaced apart cams one on each side of said rib projection to form a set and which are integral with the inner dihedral wall of said tray and said recesses are struck out of said wing to receive said cams, there being one pair of cams above said bottom planar floor of said tray and another set below said bottom planar wall, the cams of the bottom set being closer together than the cams of the top set.

3. A rack as claimed in claim 1 wherein said trays are rectangular in shape and said dihedral supporting legs have a cross section of about 90°.

4. A rack as claimed in claim 2 wherein said trays are rectangular in shape and said dihedral supporting legs have a cross section of about 90°.

5. A rack as claimed in claim 4 wherein said wing portions are thinner than the body portion of said supporting legs.

6. A rack as claimed in claim 5 wherein openings are provided in the bottom corner of the tray between the rib projections and the corner.

* * * * *